US006251158B1

(12) United States Patent
Dube et al.

(10) Patent No.: US 6,251,158 B1
(45) **Date of Patent: *Jun. 26, 2001**

(54) PRODUCTION OF GRANULES OF REACTIVE METALS, FOR EXAMPLE MAGNESIUM AND MAGNESIUM ALLOY

(75) Inventors: Ghyslain Dube, Chicoutimi; Claude Dupuis, Jonquiere; Joseph Langlais, Chicoutimi; Serge Lavoie, Jonquiere; Stephane Rompre, Sillery; Sylvain Trottier, Jonquiere; Gilles Turcotte, Ottawa, all of (CA)

(73) Assignee: Alcan International Limited, Montreal (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/347,049

(22) Filed: Jul. 2, 1999

Related U.S. Application Data

(62) Division of application No. 08/809,018, filed on Jul. 23, 1997, now Pat. No. 5,951,738, and a continuation of application No. PCT/CA95/00605, filed on Oct. 27, 1995.

(51) Int. Cl.[7] ..... B22F 9/08

(52) U.S. Cl. ..... 75/331; 75/332; 75/366; 65/19

(58) Field of Search ..... 75/331, 332, 333, 75/336, 366; 264/12; 65/19, 141

(56) References Cited

U.S. PATENT DOCUMENTS

| | | | | |
|---|---|---|---|---|
| 4,104,342 | * | 8/1978 | Wessel et al. | 264/12 |
| 4,428,894 | * | 1/1984 | Bienvenu | 264/9 |
| 4,643,753 | * | 2/1987 | Braun | 65/21.3 |
| 5,255,900 | * | 10/1993 | Schott | 65/19 |
| 5,352,267 | * | 10/1994 | Yoshino et al. | 75/333 |
| 5,549,732 | * | 8/1996 | Dube et al. | 75/331 |
| 5,951,738 | * | 9/1999 | Dube et al. | 75/331 |

* cited by examiner

*Primary Examiner*—George Wyszomierski
(74) *Attorney, Agent, or Firm*—Cooper & Dunham LLP

(57) ABSTRACT

A process of producing granules of a reactive metal. The process comprises providing a source of molten reactive metal (41), forming discrete droplets (53) of the molten metal, contacting the droplets while still substantially molten with a fluidized bed of particles (12) maintained at a temperature substantially below the solidus temperature of the metal and freezing the droplets as discrete granules of the reactive metal in the fluidized bed. The invention also provides apparatus for carrying out the method and product produces by the method, including a magnesium-containing additive for aluminum alloying. The use of a fluidized bed for cooling and freezing the droplets avoids problems encountered in prior methods and also makes it possible to provide coatings of various kinds on the surfaces of the granules, if desired.

34 Claims, 4 Drawing Sheets

PRODUCTION OF GRANULES OF REACTIVE METALS, FOR EXAMPLE MAGNESIUM AND MAGNESIUM ALLOY

This is a divisional of application Ser. No. 08/809,018 filed Jul. 23, 1997, now U.S. Pat. No. 5,951,738, and a continuation of PCT/CA95/00605, filed Oct. 27, 1995.

TECHNICAL FIELD

This invention relates to the production of solid metallic granules from molten metal and, in particular, to the production of granules of a reactive metal such as magnesium or a magnesium alloy.

BACKGROUND ART

There is a need in industry for reactive metal granules and, in particular, for granules of Mg or Mg alloy for the treatment of steel, aluminum or other metals and for other purposed such as thixotropic injection moulding. These applications require granules of at least 1 mm in size and the granules should be substantially free of surface oxides. For some uses, granules coated with a layer protecting them from oxidation may be advantageously used and various salts, for example, have provided this advantage.

There are few commercial processes which directly produce reactive metal granules. For many applications, such granules are produced by cutting or shearing material from larger pieces of metal.

U.S. Pat. No. 4,457,775 issued on Jul. 3, 1984 to Legge et. al. discloses a method for producing Mg granules by mixing Mg into a salt bath of specific composition with agitation, then partially separating the product from the bath to obtain a salt/granule mixture. Because of the production method, the composition is somewhat variable.

Metal granules or shot from less reactive metals (iron, steel, copper, etc.) have been produced by injection from a nozzle into liquid baths or into counter-current gas streams. The former process is a difficult operation for a reactive metal and the latter process requires a spray tower of substantial height, and is limited in practice to granules of small diameter because of cooling considerations.

Furthermore, in order to be adapted to reactive metals, substantial quantities of inert gas would be required.

PCT publication WO-A-86 06013 (and equivalent U.S. Pat. No. 4,915,729) disclose a process in which a molten metal is contacted with a bed of moving beads. The molten metal breaks up into fine particles which are rapidly cooled in contact with the beads. However, the mechanical agitation produces particles of metal in the form of angular flakes rather than spherical granules. The method is not well suited to the formation of particles of reactive metals, since the large surface area tends to encourage oxide formation and reaction.

There is accordingly a need for an improved method of producing granules of reactive metals.

DISCLOSURE OF THE INVENTION

An object of the present invention is to provide a method for producing acceptably uniform metal granules, preferably of a reactive metal, with substantially no surface contamination Another object of the invention is to provide a method for producing acceptably uniform metal granules, preferably of a reactive metal, of a size range suitable for alloying with metals, for example steel or aluminum.

Another object of the invention is to provide a method for producing metal granules, preferably of a reactive metal, which avoids the use of molten salt baths, liquid coolants and excessive quantities of gas.

Yet another object of the invention is to provide a method for producing reactive metal granules, preferably magnesium or magnesium alloy granules, that can be coated or doped in a controlled manner to reduce oxidation of the granules or to provide other chemical additives (such as fluoride or chloride salts) to the granule product.

Still another object of the invention is to provide a novel magnesium granule product for use in metal alloying applications.

According to one aspect of this invention, there is provided a process of producing granules of a metal, comprising providing a source of molten metal having a solidus temperature; forming discrete droplets of said molten metal from said source; fluidizing a bed of particles by means of a gas, and maintaining said bed at a temperature substantially below the solidus temperature of the metal, said particles being of a size substantially smaller than granules produced by freezing said droplets; immersing said droplets while still substantially molten in said fluidized bed of particles to freeze said droplets as discrete granules of metal in said bed; and removing said granules from said fluidized bed.

The invention is particularly suited for the production of reactive metal granules but may, if desired, be used for producing granules of other metals, e.g. non-reactive metals of many different kinds.

According to another aspect of the invention, there is provided apparatus for producing granules of a metal, comprising a source of molten metal having a solidus temperature; a droplet forming device for forming discrete droplets of molten metal from said source; a bed of particles for receiving droplets of molten metal from said droplet forming device while said droplets are still substantially molten; means for introducing a gas for fluidizing the bed; cooling equipment for maintaining said fluidized bed at a temperature substantially below the solidus temperature of the metal; and a separator for separating solidified granules of said metal from particles of said fluidized bed.

According to yet another aspect of the invention, there is provided magnesium-containing alloying additive for use in aluminum alloying, comprising granules of a magnesium-containing metal having a solidus temperature, said granules being at least partially coated with a chloride salt and having a granule size in the range of 1 to 10 millimeters, said chloride salt being attached to said granules, at least in part, by physical embedding of said salt into surface of said granules. The magnesium containing metal may be either magnesium or a magnesium alloy.

The reactive metals to which the present invention preferably relates are characterized as being sufficiently reactive with air or water such that the use of water or large quantities or air to quench and cool the metal granules would give rise to substantial oxidation of the product. Many metals in Group Ia, IIa or IIIa are of this type, e.g. lithium, sodium, potassium, cesium, magnesium, calcium, beryllium, aluminum, and strontium, and most importantly aluminum and magnesium and their alloys.

Discrete droplets of the metal can be formed in a number of ways, e.g. by the use of a vibrating nozzle, or by the use of a fixed nozzle or array of fixed nozzles. It is particularly preferred because of cheapness and reliability to use an array of fixed nozzles. When using fixed nozzles, the droplet size may be controlled not only by the nozzle diameter but also by the differential pressure of the molten metal applied to the upstream side of the nozzle, and by the nozzle geometry.

The fluidized bed of particles may consist of a wide range of particulate materials, for example, metals (e.g. as metal shot), carbon or graphite, refractory materials or salts. The particle sizes are selected to be substantially smaller than the desired product granule size, and of a size that can be readily fluidized. Suitable particle sizes are typically in the range 30 to 200 Tyler mesh (74 to 500 microns). Particles of refractory materials and salts, and mixtures of the two are particularly useful.

Fluidized bed particles may be selected to have a composition and size such that they react at a slow rate with the metal granules to form surface coatings. Particles may alternatively be selected to be non-reactive with the metal granules. In this case, bed particles can be chosen that adhere to the metal granule surface as it solidifies within the bed to form a full or partial coating of non-reactive particles, at least partially embedded in the surface of the granule. If non-reactive bed particles have a melting point near or below the temperature of the metal used to form the granules, partial melting of the particles can occur as the metal granules contact the particles, further improving the coating quality.

The fluidized bed is operated at an average temperature below the solidus temperature of the metal and preferably at least 100° C. below the solidus temperature of the metal and most preferably at least 200° C. below the solidus temperature. The temperature of the bed is preferably selected to provide adequate cooling of the solidifying metal granules, but also to control the degree of reaction when reactive bed particles are used or the quality and extent of coating when non-reactive bed particles are used.

The fluidized bed is fluidized by a gas or gas mixture that is preferably substantially non-reactive with the metal. The gas mixture may, however, contain small quantities of gases that are reactive with the metal granules to form solid salts on the metal surface to impart protection against oxidation or other useful properties.

When granules of magnesium or magnesium alloys are produced, salts such as $AlF_3$, $CaF_2$, etc., when used in the fluidized bed, allow chemical reactions with the magnesium to take place, which results in the formation of a full or partial layer of a compound (eg $MgF_2$) on the surface of the granule, providing protection from oxidation or other useful properties. When a refractory material, such as alumina, is used in the fluidized bed for the production of magnesium granules, chemical reactions with the magnesium can result in full or partial layers of compounds, such as spinel, on the surface of the granule.

Magnesium granules produced with non-reactive salt coatings are particularly useful for subsequent injection into baths of aluminum for alloying purposes. Salts which melt below the temperature of the aluminum bath are effective for this purpose, particularly salts which melt below 750° C. It is preferred that such salts melt below the temperature of the magnesium metal used in forming the granules and in particular it is preferred that the salts melt below 700° C.

A preferred slat for this application is a NaCl-KCl mixture. Coatings of this type will melt on contact with the aluminum melt and thus offer a low heat transfer resistance to the melting of the magnesium granules. Moreover, the liquid salt layer or zone does not offer any mechanical resistance to mixing and therefore allows easy dispersion of the liquid magnesium droplets.

For production of magnesium granules, the fluidized bed is preferably operated using non-reactive gases such as argon, nitrogen or carbon dioxide. Gas mixtures containing a small quantity of reactive component such as sulphur hexafluoride may be used to form small and controlled quantities of salts (magnesium fluoride) on the surface of the granule. Gas mixtures in which the minor component stabilizes the granule surface chemistry and thereby permits a normally reactive major component to be used are also useful. For example a mixture of air with sulphur hexafluoride can be used.

For the production of magnesium granules, the fluidized bed is operated at a temperature of less than 500° C. and preferably less than 350° C. For practical purposes it is usual to operate the bed above ambient temperature and preferably above 50° C. When used with salts that partially melt to form non-reactive coatings (e.g. NaCl-KCl), the average bed temperature is normally at least about 100° C. less than the melting point of the salt, and the actual bed temperature may be selected based on the degree of coating desired on the granules. At very low bed temperatures, the bed materials are substantially non-reactive and do not adhere strongly when in contact with the granules, and therefore, by adjusting the bed temperature, not only can the degree of reaction or coating be adjusted, but at the lowest temperatures, the bed permits substantially contamination free granules to be produced.

To produce magnesium granules coated with a non-reactive, low melting point salt that are particularly useful for injection into aluminum baths for alloying purposes, the fluid bed conditions are controlled to give a partial coating of chloride salts on the granule surface, and minimal surface oxides. The amount of chloride salt on the magnesium granule surfaces is ideally less than 5% by weight and preferably less than 2% by weight to ensure the rapid melting and mixing required by the product.

To maintain the desired temperature in the fluidized bed, the fluidized bed may be cooled by any convenient method of indirect cooling. The preferred cooling method, however, is to have heat exchanger coils inserted within and around the bed. Alternatively, bed material may be removed in a continuous manner, cooled in a secondary fluidized bed unit, and then returned to the main bed.

In the process of the invention, the solidified granules form regular shapes, usually spheres or flattened spheres. They do not usually have elongated tails or contain substantial shrinkage cavities. The lack of tails or large shrinkage cavities is particularly useful when the granules are used for alloying purposes. Whilst not wishing to be bound by any theory, it is believed that the fluidized bed provides a form of contact with the molten metal droplets that does not distort the liquid in any way, and because of the presence of particles at a temperature within the preferred range, the rate of cooling of the granules permits the formation of relatively large granules (1 to 10 mm, for example) without significant shrinkage cavities or other such features.

Granules prepared by the process of the present invention may be removed from the bed by any convenient method, provided the removal method does not introduce reactive gases into the bed. For example, the process may be run as a batch process by operating the fluid bed until a layer of metal granules is produced at the bottom of the bed and then stopping the process to remove the granules. It is particularly advantageous, however, to run the process as a continuous or a semi-continuous process by providing a continuous or semi-continuous molten metal feed and a means of continuous granule removal means. One such removal means is a commercially well known pneumatic-knife or air classifier separation system.

BEST MODE FOR CARRYING OUT THE INVENTION

Figure 1:
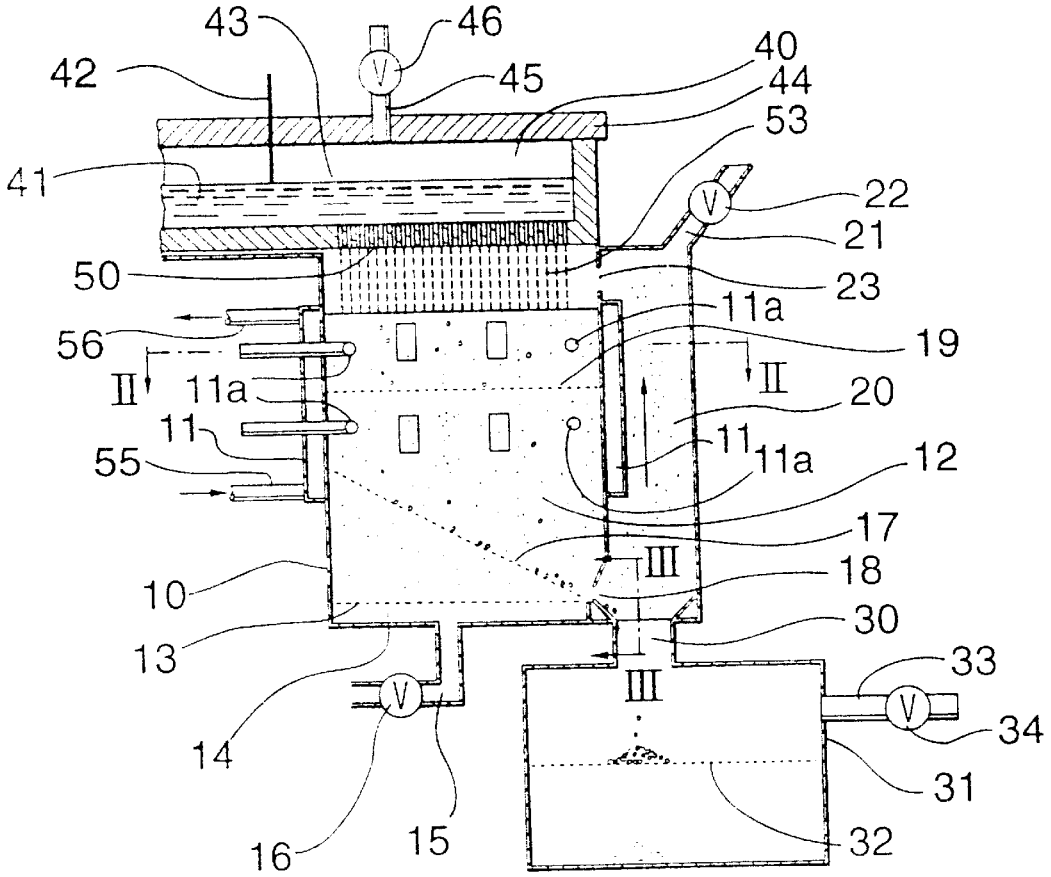
FIG. 1 shows a vertical cross-section of a fluidized bed apparatus used to carry out the process of the present invention in a preferred embodiment.
Figure 2:
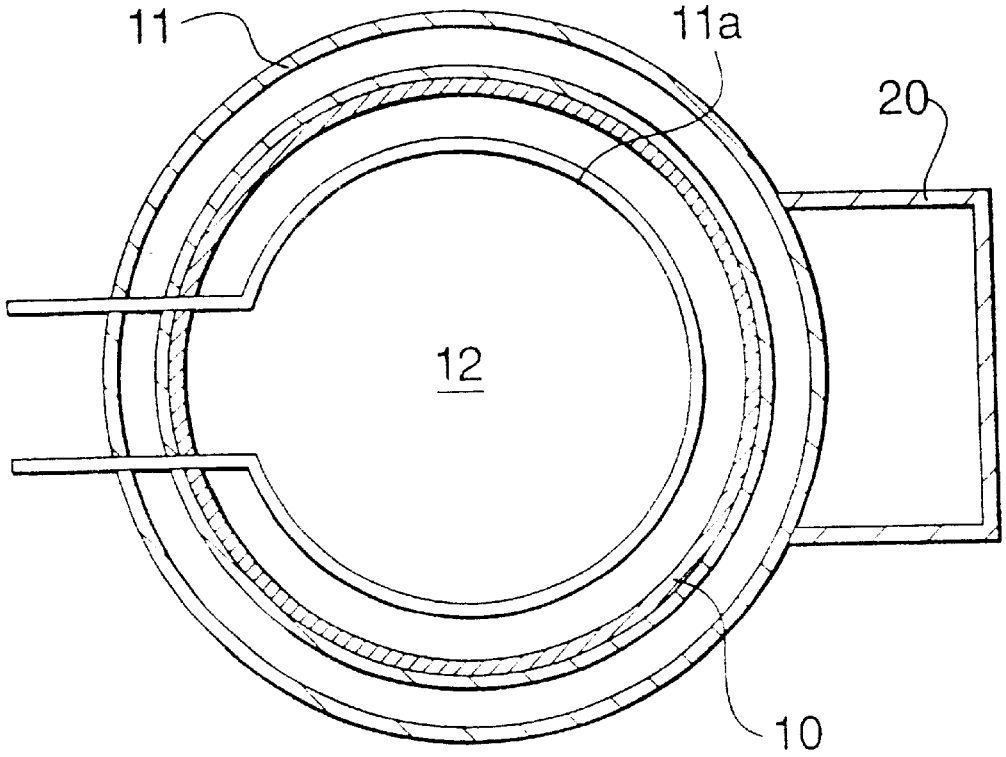
FIG. 2 shows a horizontal cross section of the apparatus of FIG. 1 taken through one of the cooling coils, along line II—II.
Figure 3:
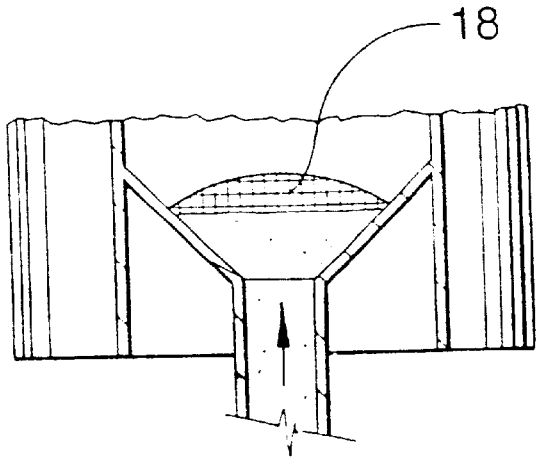
FIG. 3 is a cross-section of part of the apparatus of FIG. 1 taken along the line III—III.

A preferred fluidized bed apparatus is shown in FIG. 1. In this apparatus, a bed of particles 12 is contained within a vessel 10. A cooling jacket 11, with coolant inlet 55 and coolant outlet 56, is provided around the outer surface of the vessel 10 and cooling channels 11*a* (shown more clearly in FIG. 2) are provided within the interior of the vessel. The particles 12 to be fluidized are supported on a fluidization plate 13. Behind this plate is a plenum chamber 14 formed between the fluidization plate and the bottom of the vessel, and this chamber is fed by a fluidization gas via a connecting pipe 15 and control valve 16. Within the particle bed 12, and supported from the vessel walls, is a horizontal screen filter 19 with openings of size 13×13 mm or as required to trap oversized granules which might block the granule removal system. A second screen 17 with openings of 2 mm diameter, or as required to provide a lower size cutoff for the product granules, is located lower in the vessel and is sloped towards an outlet 18 (shown in greater detail in FIG. 3) in the side of the vessel at the bottom. Outlet 18 is approximately semi-circular with a radius of about 50 mm. This outlet communicates with a vertical gas channel 20 on the side of the vessel 10 entraining an upward flow of gas as shown by the arrow, and together these features form a pneumatic knife for separation of product granules from the particles of the fluidized bed. The vertical gas channel terminates in a duct 21 in which is positioned a pressure control valve 22. The vessel 10 has an opening 23 above the surface of the particle bed 12 also communicating the gas channel 20.

The bottom of the gas channel 20 communicates via a passage 30 leading to a product collection bin 31. This contains a screen 32, which allows bed particles that may be entrained with the larger product granules to fall through whilst retaining product granules on the screen. The bed particles are periodically removed and returned to the fluidized bed and the product granules are also periodically removed. A source of gas for the pneumatic knife is provided via the feed pipe 33 and the flow of gas is controlled by a valve 34.

Figure 6:
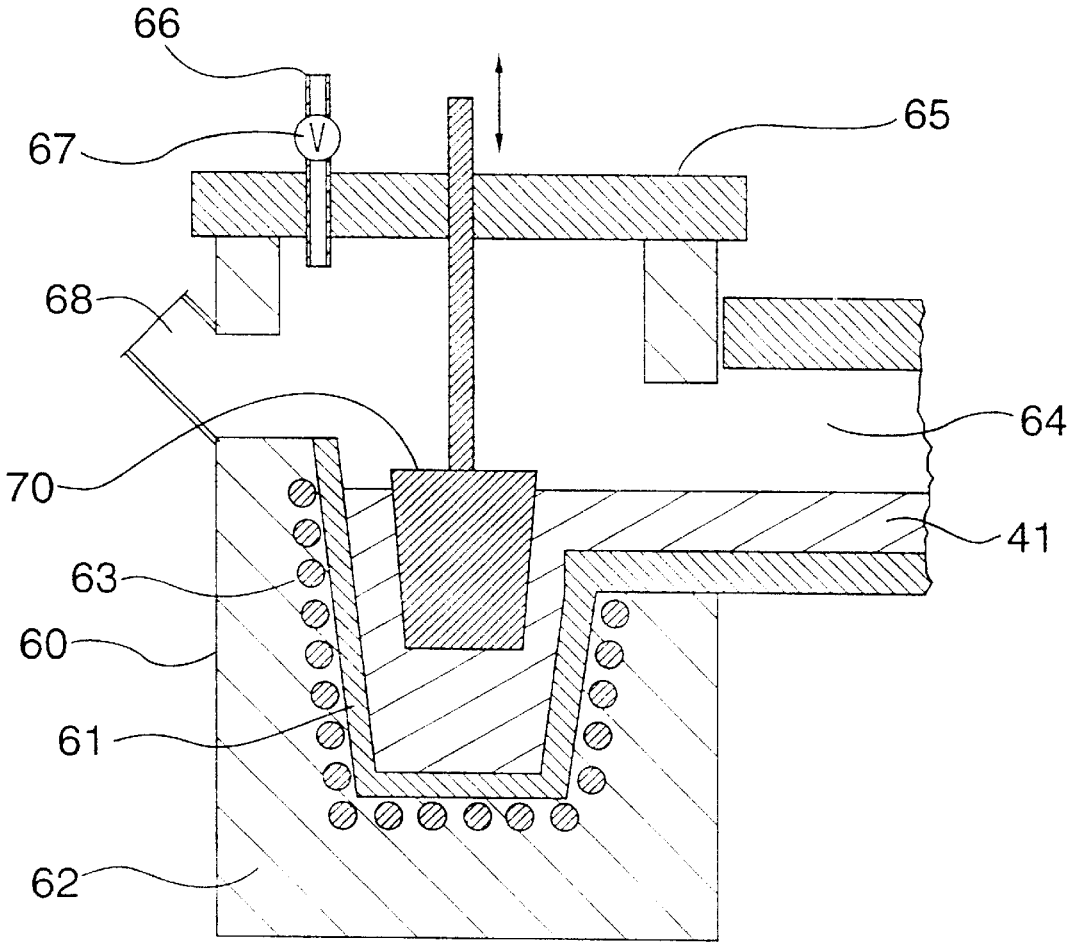
FIG. 6 shows a molten metal feeding furnace that may be used in this invention.

In the top of the vessel 10, a molten metal feed trough 40 is provided, which is fed with molten metal 41 from an external source (not shown in FIG. 1, but see FIG. 6). A metal level sensor 42 is provided which is used to control the external feed to maintain the metal surface 43 at a constant level in the trough. The metal feed trough is covered by a cover 44 which contains a cover gas inlet 45 and control valve 46.

Figure 4:
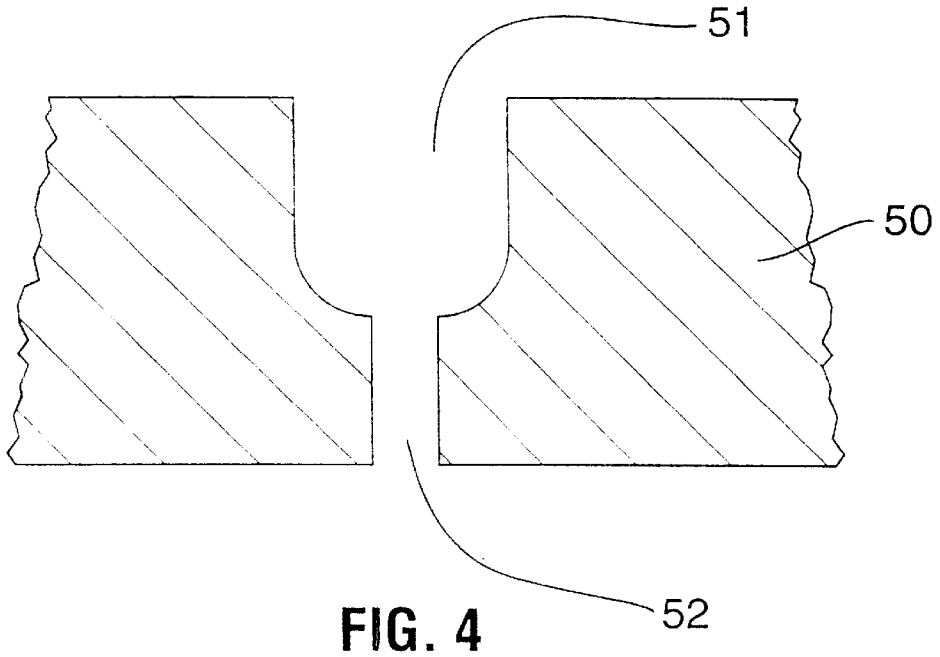
FIG. 4 shows a vertical cross-section of a nozzle within the nozzle plate of the apparatus of FIG. 1.

The bottom surface 50 of the molten metal feed trough forms a nozzle plate containing a multiplicity of nozzles. An individual nozzle formed in the bottom surface 50 of the molten metal feed trough is shown in FIG. 4 and consists of an upper cylindrical opening 51 and a smaller lower cylindrical orifice 52. Molten metal flows through the opening 51 and the orifice 52 under the effect of gravity (and possibly differential gas pressure) to form individual droplets 53 (see FIG. 1).

Figure 5:
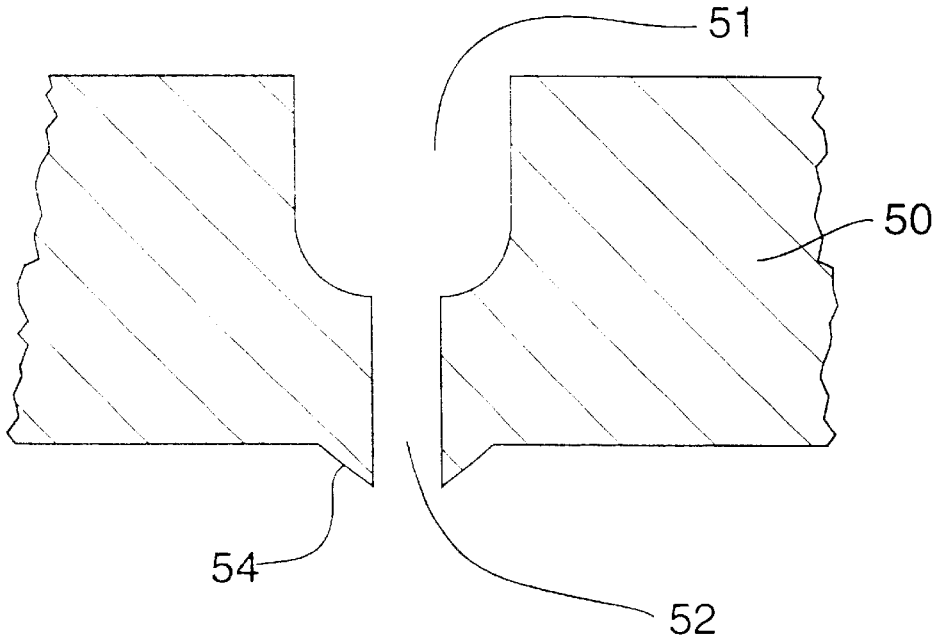
FIG. 5 is a view similar to FIG. 4 of an alternative nozzle plate.

An alternative nozzle design is shown in FIG. 5 in which the underside of the nozzle plate 50 has a nozzle extension or tip 54 (that is preferably inwardly tapering and optimally frustoconical) surrounding the lower outlet of each orifice 52 and projecting downwardly from the underside of the nozzle plate 50. The nozzle tips 54 improve the reproducibility of metal droplet formation by reducing any tendency of the metal to flow along the underside of the nozzle plate rather than to remain concentrated around the outlets of the orifices 52. The lengths and angles of taper of these tips may vary considerably, but may be chosen to optimize the reproducibility of droplet formation without unduly complicating the design of the nozzle plate 50.

FIG. 6 shows one embodiment of a molten metal source for use with the apparatus of FIG. 1. It consists of a electrically heated crucible furnace. The furnace is enclosed within a shell 60. Metal is melted within a crucible 61, contained within insulation 62 and heated by electrical resistance heaters 63. An exit trough 64 is provided which connects to the molten metal trough 40 of the fluid bed apparatus. A cover 65 is provided and contains a port 66 and valve 67 through which a cover gas may be fed. A covered port 68 is provided for adding metal ingots. A displacement block 70 is provided which can be adjusted vertically (as shown by the arrow) by an external actuator (not shown) which in turn responds to the metal level sensor 42 in the fluid bed apparatus. The molten metal source provides the metal 41 for the trough 40 of the fluid bed apparatus.

The fluidized bed 12 preferably consists of particles in the size range 30 to 200 mesh (74 to 500 microns). In operation, the bed is fluidized by a gas (generally argon) entering via feed pipe 15 and valve 16. The gas is preferably regulated to give an average velocity of 0.01 to 0.1 m/second, sufficient to fluidize the bed. The bed consists typically of aluminum fluoride, alumina, calcium fluoride or NaCl-KCl.

The pneumatic knife channel 20 is preferably fed by gas at a gas velocity (in channel 20) of between 0.02 to 1 m/sec in order to generate a bubbling fluidized bed mode of operating at the bed exit location. Argon or air may be used since there is little leakage into the bed from the channel 20. The pressure control valve 22 in the exhaust duct 21 controls the pressure in the bed 12 and the duct 20 and maintains it at a preset level generally slightly in excess of atmospheric pressure. These conditions cause any bed particles escaping by the opening 18 to be suspended in the gas flow whilst the larger product granules fall into the collection bin 31 via the passage 30. The suspended bed particles then return to the bed via opening 23, or may be collected and returned periodically to the bed. Some bed particles may fall into the collection bin 31 along with the product granules, and the screen 32 ensures that these are separated from the product granules and they may be collected and may returned to the fluidized bed when required.

The bed is heated in operation by the inflow of molten metal, but the temperature is controlled by flowing coolant through the channels 11 at a rate sufficient to maintain the bed temperature at a preset level within the range 50 to 350° C. or more preferably 50 to 150° C. The lower range is used when reaction between the bed particles and the molten metal is to be avoided.

When the bed is operated in the above manner, the fluidized bed operates in a relatively quiet mode, and uses relatively little gas, making for an economic operation. The high heat capacity of the bed particles compared to the gas results in very effective cooling of the metal granules. The bed particles are kept in sufficient motion by the fluidizing conditions to ensure that the heat deposited in the bed particles by the cooling granules is effectively removed by the cooling channels. The larger product granules can effectively move downward through the fluidized bed during cooling for collection and removal at the bottom.

In operation molten metal 41 is supplied to the metal trough 40 at a rate sufficient to maintain the metal level at a constant level. The metal flow through the nozzle plate 50 and the size of the droplets 53 formed is then controlled by the nozzle geometry the differential pressure across the nozzle plate. This differential pressure is the difference between the metal head and the pressure in the bed controlled by valve 22.

Although a number of combination of nozzle size, metal head and bed pressure may be used, it has been found convenient to use a nozzle with an upper cylinder of diameter 0.32 cm (⅛ inch), and lower cylinder of diameter 0.12 cm (0.047) inch and height 1.9 cm (0.75 inch). Typically, a nozzle plate will have 25 to 30 nozzles for a throughput of 90 kg/hr of molten metal. A metal head of about 50 mm and a bed pressure of 2.54 cm (1 inch) of water gives suitable metal droplet flow and sizes. To prevent oxidation of the metal in use, a cover gas is added via port 45 and valve 46. The feed rate is maintained to create a very slight positive pressure in the area above the molten metal 41, but because the cover on the trough is not tight fitting the pressure above the metal is substantially atmospheric. A variety of non-reactive cover gases may be used, but in the case of molten magnesium, a mixture containing $SF_6$ is particularly useful.

A metal head preferably between 25 and 75 mm and a number of different sources of molten metal may be used with this invention provided that they can ensure a constant metal head in the metal trough 40. For example, a tilting furnace can be used, where the tilt control and hence metal feed rate is controlled by the metal level sensor 42. Another method is shown in FIG. 6 where, in operation, the crucible 61 is charged with ingots (for example of magnesium) and these are heated to above the melting point (680 to 700° C. for magnesium). The metal displacement block 70 is then adjusted to maintain the level of metal constant in the metal trough. As the metal in the furnace is consumed, more ingots can be added at the port 68.

The invention is illustrated in more detail by the following Examples, which should not be considered to limit the scope of the invention.

EXAMPLE 1

Magnesium granules were produced using the apparatus and method of the present invention. 300 kg of magnesium ingot were melted in an electric furnace and raised to a temperature of 710° C. A displacement block was used to raise the level of molten metal so that it flowed into the metal trough over the fluid bed. A differential pressure of 10.2 cm (4.0 inches) of water was maintained across the metal over the nozzle plate and this created molten metal droplets of average volume 0.112 $cm^3$ and a metal feed rate of about 1.5 kg/minute. The molten metal droplets fell on a bed consisting of aluminum fluoride particles in the size range 0.075 to 0.5 mm (30 to 200 Tyler mesh), maintained at a temperature of 100±5° C. The bed volume was 0.1$m^3$. The bed was fluidized with argon at a flowrate sufficient to ensure a velocity of 0.02 m/sec within the bed. The pneumatic knife operated with argon at a flow velocity of 0.05 m/sec, corresponding to a flow rate of 3.5 $m^3$/hr.

Under these conditions, magnesium granules of generally spherical shape were produced with 92% in the size range 4.7 to 6.7 mm. The spherical granules formed in the process had only small shrinkage cavities and had a shiny appearance. The granules had a thin surface coating of $MgF_2$ and no strongly adhering salt particles.

EXAMPLE 2

Magnesium granules were fabricated in a manner identical to Example 1 except that the bed temperature was maintained at 150±5° C. In this case the granules had a black appearance and were more substantially coated with a layer of magnesium fluoride than in Example 1.

EXAMPLE 3

Magnesium granules were fabricated using the apparatus and method of Example 1, but using a 50% NaCl-50% KCl (m.p.=654° C.) salt mixture as the fluid bed medium. The granules produced had a metallic-like finish with a discontinuous coating of NaCl/KCl particles anchored to the surface. The amount of chloride salt adhering to the final product after screening was about 1% by weight of the product.

The melting behaviour of these granules was tested on a small scale by immersing the granules below the surface of an aluminum melt and determining the time required for the granules to melt. No agitation was used. The melting times of the granules coated with chloride salts of this invention were compared to the melting times for other coatings produced by the apparatus and method of this example. Results are shown in Table 1, and indicated that the chloride coated granules of this invention melted substantially faster in this test than other granules. The granules of this invention melted sufficiently fast that, on injection below the surface of a commercial aluminum bath, they would be expected to be fully melted and dispersed before buoyancy forces caused them to reach the surface of the aluminum bath and oxidize.

TABLE 1

| Bed media used | Coating | Time to melt |
|---|---|---|
| $AlF_3$ (reactive) | $MgF_2$ | >60 seconds |
| $CaF_2$ (reactive) | $MgFD_2$ (less) | >60 seconds |
| $MgO.Al_3O_3$ (non-reactive) | Spinel (anchored particles) | 24 seconds |
| NaCl (non-reactive) | NaCl (anchored salt particles) | 5.5 seconds |
| 50% NaCl: 50% KCl (non-reactive) | NaCl-KCl (anchored salt particles) | 1.1 seconds |

What is claimed is:

1. A process of producing granules of a material comprising metal, comprising:

providing a source of material comprising molten metal having a solidus temperature;

forming discrete droplets of said material comprising molten metal from said source;

fluidizing a bed of particles by means of a gas, and maintaining said bed at a temperature substantially below the solidus temperature of the molten metal;

immersing said droplets while still comprising substantially molten metal in said fluidized bed of particles to freeze said droplets as discrete product granules of material comprising metal in said bed;

said particles being of a size that is substantially smaller than the size of said product granules and of a size that makes said particles readily fluidizable by said gas; and removing said product granules from said fluidized bed.

2. A process according to claim 1 wherein said metal is a reactive metal.

3. A process according to claim 1 wherein said metal is selected from the group consisting of metals of Group Ia, Group IIa and Group IIIa of the Periodic Table.

4. A process according to claim 1 wherein said metal is selected from the group consisting of Al, Mg and alloys thereof.

5. A process according to claim 1 wherein said metal is selected from the group consisting of Mg and alloys thereof.

6. A process according to claim 5 which comprises maintaining the fluidized bed at a temperature below 500° C.

7. A process according to claim 5 which comprises maintaining the fluidized bed at a temperature below 350° C.

8. A process according to claim 1 which comprises forming said droplets by passing said molten material comprising metal through an array of fixed nozzles.

9. A process according to claim 1 which comprises maintaining the fluidized bed at a temperature at least 100° C. less than the solidus temperature of the metal.

10. A process according to claim 1 which comprises forming said discrete droplets of such a size that said granules formed are at least 1 mm in diameter.

11. A process according to claim 1 which comprises forming said discrete droplets of such a size that said granules formed are in the size range 1 to 10 mm in diameter.

12. A process according to claim 1 which comprises employing, as said particles of said bed, particles of a material that is substantially unreactive with said material comprising metal.

13. A process according to claim 1 which comprises employing, as said particles of said bed, particles that partially embed within the surface of the droplets as said droplets solidify.

14. A process according to claim 1 which comprises employing, as said particles of said bed, particles of a material that reacts with said material comprising metal to form a protective coating on surfaces of said granules.

15. A process according to claim 1 which comprises employing, as said particles of said bed, particles of a substance that partially melts on contact with said droplets.

16. A process according to claim 1 which comprises employing, as said particles of said bed, particles of a substance selected from the group consisting of metals, carbon, graphite, refractories and salts.

17. A process according to claim 16 which comprises employing solid salt particles as said particles of said bed.

18. A process according to claim 17 wherein said salt remains solid when contacted with said droplets and reacts with said material comprising metal to form a protective coating on surfaces of said granules.

19. A process according to claim 18 wherein said material comprises a metal selected from the group consisting of magnesium and magnesium alloys, and said salt is a fluoride salt.

20. A process according to claim 17 wherein said salts is non-reactive with said material comprising metal and embeds within the surface of the droplets as said droplets solidify.

21. A process according to claim 20 wherein said salt partially melts on contact with said droplets.

22. A process according to claim 20 wherein the material comprises a metal selected from the group consisting of magnesium and magnesium alloys, and said salt has a melting point less than 750° C.

23. A process according to claim 20 wherein the material comprises a metal selected from the group consisting of magnesium and magnesium alloys, and said salt has a melting point less than 700° C.

24. A process according to claim 20 wherein the material comprises a metal selected from the group consisting of magnesium and magnesium alloys, and said salt is a mixture of NaCl and Kcl.

25. A process according to claim 24 wherein said material comprises a metal selected from the group consisting of magnesium and magnesium alloys, and said non-reactive gas is selected from the group consisting of argon, nitrogen and carbon dioxide.

26. A process according to claim 1 which comprises fluidizing said bed with a fluidizing gas that is non-reactive with the molten material comprising metal.

27. A process according to claim 1 which comprises fluidizing said bed with a fluidizing gas that is a gas mixture having a major component that is non-reactive with the molten material comprising metal and a minor component.

28. A process according to claim 27 which comprises employing said gas mixture in which said minor component is reactive with the material comprising metal to form a protective layer on surfaces of said granules.

29. A process according to claim 28 wherein said major component is air.

30. A process according to claim 28 which comprises employing a material comprising a metal which contains magnesium as said reactive metal and said gas mixture that contains sulphur hexafluoride as said minor component.

31. A process according to claim 30 which comprises employing air as said major component.

32. A process according to claim 1 which comprises employing, as said particles of said bed, a solid having a melting point lower than aluminum metal.

33. A process according to claim 32 which comprises employing, as said particles of said bed, a compound of NaCl/KCl.

34. A process according to claim 1, wherein the step of forming discrete droplets of said material comprising molten metal from said source creates droplets having a shape selected from the group consisting of spheres and flattened spheres, and wherein said step of immersing said droplets in said fluidized bed is carried out such that said shape of said droplets is maintained as said droplets solidify.

* * * * *